US007507924B2

(12) United States Patent
Lorenzo Riera et al.

(10) Patent No.: US 7,507,924 B2
(45) Date of Patent: Mar. 24, 2009

(54) LIGHTED MODULE APPLICABLE TO A PUSHBUTTON-TYPE SWITCH ASSEMBLY, AND A PUSHBUTTON-TYPE SWITCH ASSEMBLY WITH A LIGHTED MODULE

(75) Inventors: Miguel Angel Lorenzo Riera, Barcelona (ES); Juan José Verdu Martinez, Barcelona (ES)

(73) Assignee: Industrias Lorenzo, S.A., Barcelona (ES)

( * ) Notice: Subject to any disclaimer, the term of this patent is extended or adjusted under 35 U.S.C. 154(b) by 77 days.

(21) Appl. No.: 11/708,189

(22) Filed: Feb. 20, 2007

(65) Prior Publication Data

US 2007/0193867 A1 Aug. 23, 2007

(30) Foreign Application Priority Data

Feb. 20, 2006 (EP) ..... 06075384

(51) Int. Cl.
*H01H 9/00* (2006.01)

(52) U.S. Cl. ..... 200/314; 200/341

(58) Field of Classification Search ..... 200/310–314, 200/341–345

See application file for complete search history.

(56) References Cited

U.S. PATENT DOCUMENTS 4,096,368 A * 6/1978 Grebner ..... 200/314
4,331,852 A * 5/1982 Baran et al. ..... 200/515
4,350,857 A * 9/1982 Fillus et al. ..... 200/314
4,376,239 A * 3/1983 Long et al. ..... 200/517
6,350,039 B1 2/2002 Lee
7,132,615 B1 * 11/2006 Greer ..... 200/313
2006/0201797 A1 * 9/2006 Rastemborski et al. ..... 200/516
2008/0073190 A1 * 3/2008 Cove ..... 200/314

FOREIGN PATENT DOCUMENTS

EP 0 567 357 A1 10/1993
GB 2 350 722 A 12/2000

* cited by examiner

*Primary Examiner*—Michael A Friedhofer
*Assistant Examiner*—Lisa N Klaus
(74) *Attorney, Agent, or Firm*—RatnerPrestia

(57) ABSTRACT

A lighted module applicable to a pushbutton-type switch assembly and pushbutton-type switch assembly with lighted module is described. The module comprises a receptacle housing a printed circuit board having several LEDs and connection means. The receptacle includes at least one translucent or transparent portion, aperture or hole through which light is emitted from said LEDs towards a translucent or transparent portion of a base body of a pushbutton-type switch assembly, and an orifice through which the connection means are connected to an electric circuit. The receptacle and said printed circuit board comprising respective mutually aligned apertures for insertion of a stem of said base body so that the receptacle with the printed circuit board can be jointly installed with the pushbutton-type switch assembly internally or externally to a panel.

18 Claims, 6 Drawing Sheets

LIGHTED MODULE APPLICABLE TO A PUSHBUTTON-TYPE SWITCH ASSEMBLY, AND A PUSHBUTTON-TYPE SWITCH ASSEMBLY WITH A LIGHTED MODULE

STATE OF THE ART

The present invention relates to a lighted module applicable to a pushbutton-type switch assembly that can be of an already existing conventional type. The present invention also relates to a pushbutton-type switch assembly that is associated with such a lighted module.

STATE OF THE PREVIOUS ART

From patent US-A-6350039 a switch assembly or wall socket is known that comprises a switch or socket unit, a translucent or transparent frame surrounding said unit and a printed circuit board with a circuit including a number of LEDs arranged at regular intervals around the switch or socket assembly to emit light through said translucent or transparent frame. The assembly also includes a light guiding and reflecting body located underneath the translucent or transparent frame and a photosensitive switch connected to the board circuit to switch the LEDs on or off depending on the ambient light.

Patent EP-A-0567357 discloses a lighted button with a channelled and diffused light flow comprising a transparent tubular base body that passes through an aperture in a panel. The base body defines a laterally projecting collar at its upper end and a threaded portion at its lower end for coupling to a nut to secure the base body to said panel. An actuator assembly is mounted on the base body in such a way that it can be moved between an extended position and a retracted position against the force of an elastic element. A bottom plate is secured to the lower end of the base body, said bottom plate including a switch and a number of LEDs that can be switched on by the actuator assembly pressing on said switch. The base body is configured so that the light from the LEDs is emitted through the mentioned collar.

On the other hand, examples of conventional pushbutton-type switch assemblies are known, for example, applicable to amusement machines, which comprise a base body adapted to be fixed to a panel and an actuator assembly installed on said base body in a movable fashion between an extended position and a retracted position. An elastic element is arranged to thrust said actuator assembly towards the extended position. The actuator assembly is adapted to be pushed against the force of this elastic element in order to operate a switch fixed to the base body. The base body defines a bezel that rests on an exposed face of said panel and a stem adapted to pass through an aperture in the panel towards a hidden face of the same. The stem has an outer configuration adapted to be coupled to a securing element adapted for joining said base body to the panel. Usually, said outer configuration is a threaded portion and said securing element is a nut coupled to the stem and tightened against the hidden side of the panel. The actuator assembly defines a pushbutton adapted to be, at least partially, housed in said bezel and an appendix that passes through an passage along the length of the base body stem in order to operate said switch. Normally, a bulb or one or more LEDs are mounted inside the stem and arranged to emit light through said pushbutton, which is translucent or transparent to this end.

Patent GB-A-2350722 describes a lighted pushbutton-type switch assembly that includes the features of the conventional pushbutton-type switch assembly described above, and which also comprises a printed circuit board with a circuit including, on a first face of the board, a number of LEDs spaced apart around an aperture and connection pins that extend from a second face of the board opposite the first one. The printed circuit board is installed between a washer backed onto the exposed face of the panel and a rear surface of the base body bezel. Each LED is facing a corresponding opening formed in a collar on the bezel. A light-conducting ring made of a transparent material is fitted over the LEDs, said light-conducting ring having pins inserted into the collar openings so that the light is emitted through said pins and openings.

DESCRIPTION OF THE INVENTION

One aspect of the present invention provides a lighted module applicable to a pushbutton-type switch assembly that can be of an already existing conventional type.

Another aspect of the present invention provides a pushbutton-type switch assembly that is associated with such a lighted module.

According to a first aspect, the present invention provides a lighted module applicable to a pushbutton-type switch assembly, where said pushbutton-type switch assembly is of the type comprising a base body at one end of which a bezel is defined adapted to receive a pushbutton of an actuator assembly, and a stem adapted to be passed through an aperture in said panel. The stem has an outer configuration adapted to be coupled to a securing element adapted for joining said base body to the cited panel. Said actuator assembly is installed in such a way that it can be moved through said stem from an extended position to a retracted position against the thrust of an elastic element to operate an actuator device secured to said stem. According to the present invention, the lighted module comprises a receptacle containing a printed circuit board having a circuit that includes at least one LED and connection pins, said receptacle including at least one translucent or transparent portion or hole through which light can be emitted from said LED towards a translucent or transparent portion of the base body, and at least one aperture through which said connection pins can be connected to an electric circuit. The receptacle and said printed circuit board comprise respective apertures mutually aligned for insertion of the base body stem so that the receptacle with the printed circuit board can be installed together with the pushbutton-type switch assembly either externally between said base body bezel and the panel, or internally between the panel and said securing element. In this latter case, the light from the LED can be emitted towards said translucent or transparent portion of the base body through at least one hole or aperture in the panel.

In one preferred embodiment, said printed circuit board includes a number of said LEDs spaced around said aperture on a first face of the board, while said connection pins extend from a second face of the printed circuit board opposite said first face. The circuit of the printed circuit board is adapted to be controlled from an electronic control circuit associated with said electric circuit to which the connection pins are connected to consecutively switch the LEDs on and off in order to produce a rotating luminous signal. The LEDs are arranged on the printed circuit board so that said rotating luminous signal is emitted through a peripheral zone of the base body bezel, for which reason the base body is made of a translucent or transparent material or has at least a translucent or transparent portion.

With this construction, the module of the present invention can be associated with an already existing pushbutton-type switch assembly provided that the base body is fully, or has at least a portion made of translucent or transparent material, and, eventually, adapting the panel aperture and/or adding some holes thereto. Since an already existing base body mould can be used to mould the base body in a translucent or transparent material, such as a polycarbonate plastic, either coloured or colourless, practically any existing pushbutton-type switch assembly will be suitable for moulding in a translucent or transparent material and installed jointly with the lighted module of the present invention so that its luminous and/or aesthetic features can be enhanced. Moreover, for joining the lighted module to the assembly it is envisaged to use the same securing elements originally provided with the pushbutton-type switch assembly, so that the module is readily changeable or replaceable.

Alternatively, a purpose-built pushbutton-type switch assembly can be adapted for association with the lighted module of the present invention, incorporating, for example, a completely translucent or transparent base body or an opaque base body with one or more translucent or transparent portions.

Thus, according to a second aspect, the present invention provides a pushbutton-type switch assembly with a lighted module, wherein the pushbutton-type switch assembly is of a type comprising a base body defining at one end thereof a bezel adapted to receive a pushbutton of an actuator assembly, and a stem adapted to be passed through an aperture in said panel, said stem having an outer configuration for coupling to a securing element for joining said base body to said panel, said actuator assembly being installed in such a way that is able to be moved through said stem from an extended position to a retracted position against the thrust of an elastic element to operate an actuating element of a switch attached to said stem. According to the present invention, the pushbutton-type switch assembly is characterised in that it is associated with a lighted module of the present invention and in that the base body has a translucent or transparent portion through which light from said lighted module is emitted.

In any case, the lighted module of the present invention is in the form of a receptacle or box that contains the printed circuit board. Once the module is installed, this receptacle or box remains closed to protect the printed circuit board from environmental and other agents.

BRIEF DESCRIPTION OF THE DRAWINGS

The previous and other advantages and features will be more fully understood from the following detailed description of exemplary embodiments with reference to the attached drawings, in which.

DETAILED DESCRIPTION OF EXEMPLARY EMBODIMENTS

Figure 1:
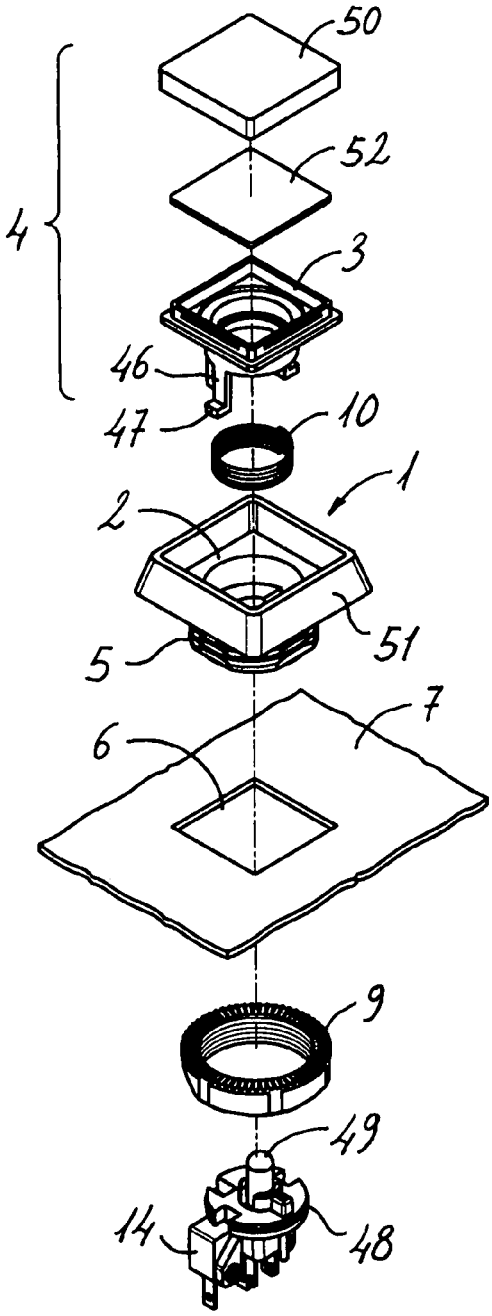
Fig. 1 PRIOR ART
FIG. 1 is an exploded perspective view of a first example of a previous art pushbutton-type switch assembly.

The various figures that accompany the following description make use of the same reference numerals to designate equal or equivalent elements. The terms "upper" and "lower" and their derivatives refer to the positions of the elements in the figures. The terms "axial" and "radial" refer to a central axis 60, in the direction of which the pushbutton is moved and in relation to which the main elements are assembled.

Figure 2:
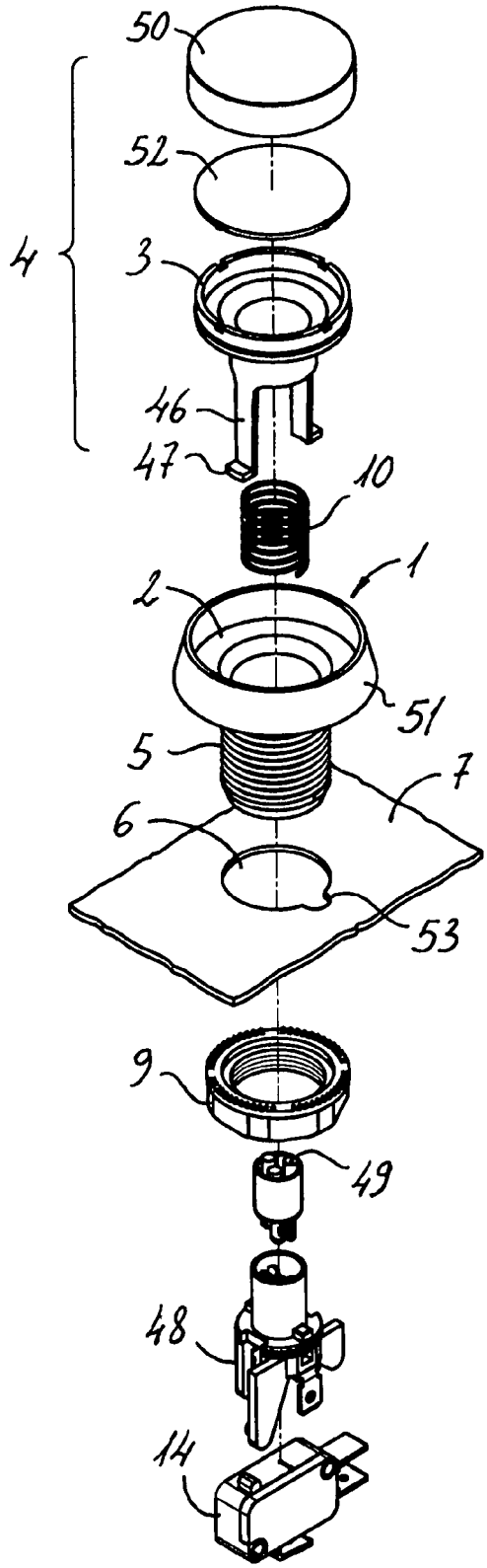
Fig.2 PRIOR ART
FIG. 2 is an exploded perspective view of a second example of a previous art pushbutton-type switch assembly.

First referring to FIGS. 1 and 2, first and second examples of previous art pushbutton-type switch assemblies are shown by way of example. Both have in common a base body 1 that defines a bezel 2 at one end from which extends downwards a stem 5 adapted to pass through an aperture 6, 6*a* of a corresponding panel 7, which forms part of, for example, an amusement machine. The stem 5 has an outer configuration such as a threaded portion adapted to receive a fastening element, such as a nut 9, to joint said base body 1 to the cited panel 7. The first and second examples of pushbutton-type switch assembly of FIGS. 1 and 2 also include an actuator assembly 4 having a pushbutton 3 formed at one end thereof, from which a pair of appendices 46 extend downwards. The mentioned bezel 2 of the base body 1 is adapted to receive the pushbutton 3 of the actuator assembly 4, the appendices 46 of which are adapted to pass through the interior cavity of the stem 5 to project from the lower end thereof. The appendices 46 are relatively elastic and have ends 47 bent outwards that abut onto the lower end of stem 5 limiting movement of the actuator assembly 4 in the axial direction between extended and retraced position. An elastic element 10, such as a helicoidal compression spring, is arranged to thrust the actuator assembly towards its extended position.

A support 48 is attached to the lower end of the stem, said support 48 carrying a switch 14 and, eventually, one or more central light-emitting devices 49 installed inside the stem 5 to emit light through a translucent or transparent cover 50 of the pushbutton 3 of the actuator 4. Optionally, under said cover 50, the pushbutton includes a translucent or transparent sheet 52 with graphic or written information. When the actuator assembly 4 is pushed towards its retracted position against the thrust of said elastic element 10, the appendices 46 are moved downwards through the stem 5 in order to operate an actuating element of said switch 14 secured to the stem 5. The switch 14 can be assigned several functions, for example related to the amusement machine to which the pushbutton-type switch assembly is applied, and the central light-emitting device or devices 49 could be controlled to switch on or off according to said functions.

There are minor differences between the first and second examples of pushbutton-type switch assembly of FIGS. 1 and 2 that merely respond to design options. For example, in FIG. 1, the bezel 2 of the base body 1 and the pushbutton 3 of the actuator assembly 4 have a square configuration, whereas in FIG. 2 they are round. In FIG. 1, the stem 5 of the base body 1 and the appendices 46 of the actuator 4 are shorter than those in FIG. 2. In FIG. 1, the stem 5 has flat faces forming four sides with the threaded portion limited at the corners so that the aperture 6 of the board 7 is square, while in FIG. 2, both the stem 5 and the aperture 6 of plate 7 are round. In FIG. 1 there is only one central light-emitting device 49 whereas there are three central light-emitting devices 49 in FIG. 2. In both FIGS. 1 and 2, the central light-emitting devices 49 are LEDs, but alternatively, they could be incandescent lamps. Obviously, there are other possible examples of pushbutton-type switch assemblies incorporating many variants that do not affect the essentials of the previous description in relation to FIGS. 1 and 2. For example, the exterior threaded portion of the stem 5 and the corresponding nut 9 could be replaced by many other securing means, such as elastic tabs (not shown) formed in the base body and provided with one or more teeth to grip the edge of the aperture 6, 6*a* of the panel 7 or an auxiliary fastening ring.

Since one aspect of the present invention provides a lighted module applicable to a pushbutton-type switch assembly, which can be of an already existing conventional type, such as those described in FIGS. 1 and 2, to emit light coming from the lighted module through the base body of the pushbutton-type switch assembly, the only condition that must be met by the pushbutton-type switch assembly is that its base body has at least one translucent or transparent portion, although in general, it is simpler for the entire base body to be moulded using a translucent or transparent material, such as a colourless or coloured polycarbonate plastic, as explained above.

Figure 3:
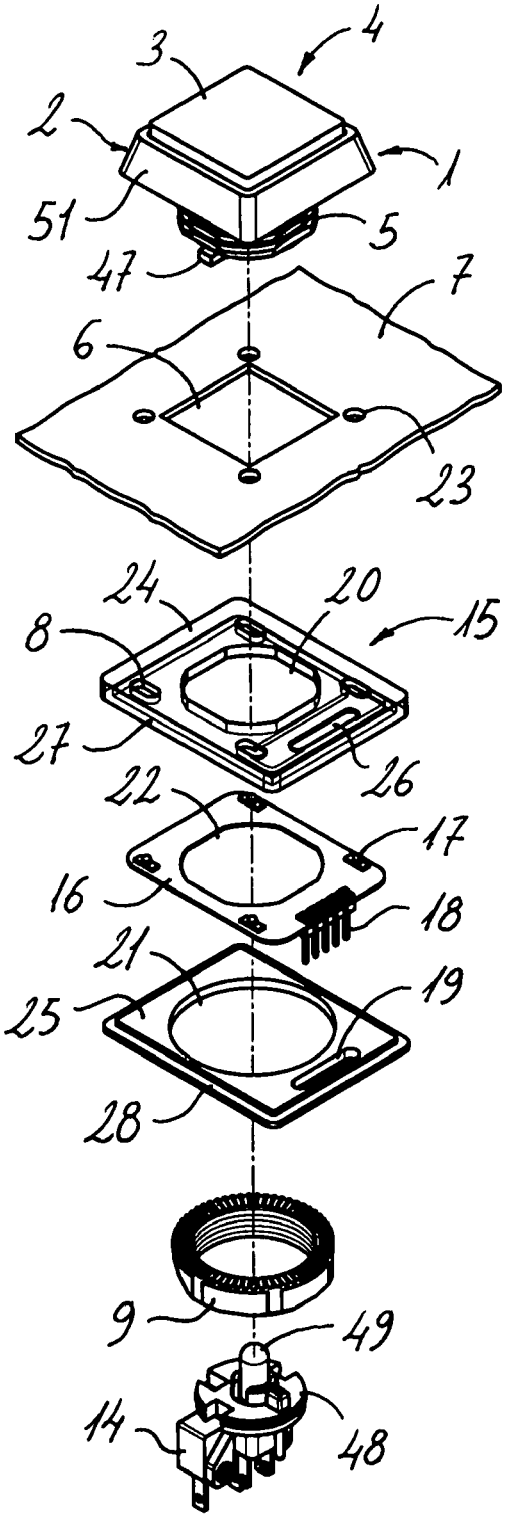
FIG. 3 is an exploded perspective view of a lighted module according to a first embodiment of the present invention to be applied to the first example of previous art pushbutton-type switch assembly shown in FIG. 1 as per a first installation example.
Figure 4:
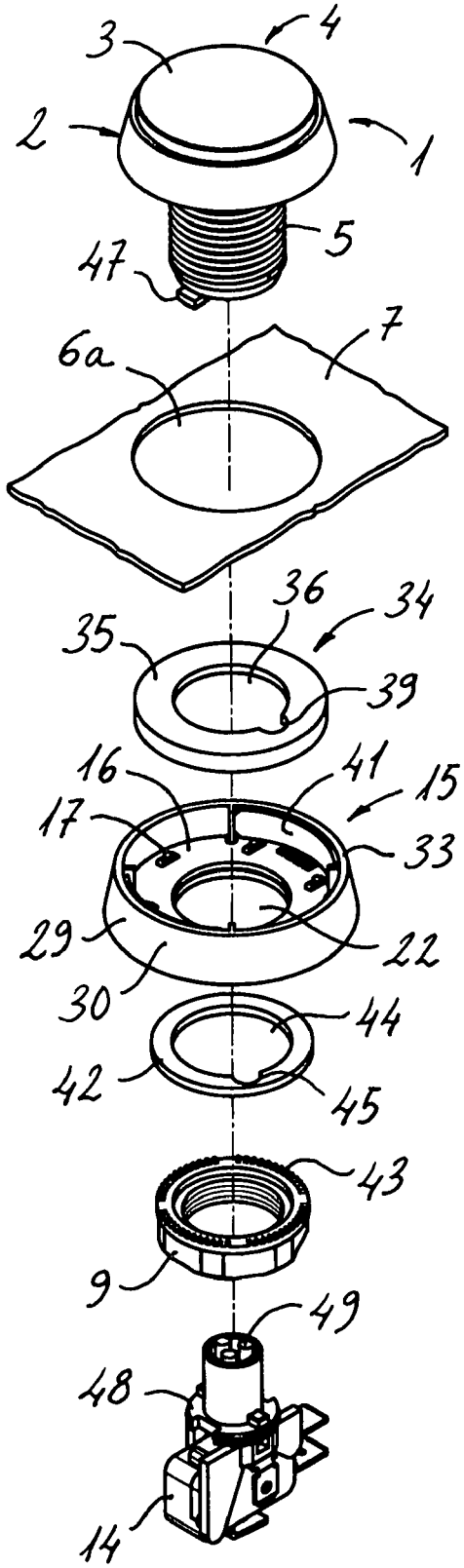
FIG. 4 is an exploded perspective view of a lighted module according to a second embodiment of the present invention to be applied to the second example of previous art pushbutton-type switch assembly shown in FIG. 2 as per a first installation example.

Now referring to FIGS. 3 and 4, first and second embodiments of the lighted module of the present invention are respectively shown to be applied to examples of a known type pushbutton-type switch assembly. The first embodiment of the lighted module in FIG. 3 is adapted to be applied to the first example of previous art pushbutton-type switch assembly previously described in relation to FIG. 1, whereas the second example of lighted module of FIG. 4 is adapted to be applied to the second previous art pushbutton-type switch assembly previously described in relation to FIG. 2.

Both first and second embodiments of the lighted module of FIGS. 3 and 4 have in common a receptacle 15 inside of which is a printed circuit board 16 with a circuit that includes a number of LEDs 17 and connection pins 18. The receptacle 15 and the printed circuit board 16 have respective mutually aligned apertures 20, 22, through which the stem 5 of the base body 1 of the corresponding pushbutton-type switch assembly can be inserted. In this way, the receptacle 15 with the printed circuit board 16 can be installed either externally to the panel 7, between said bezel 2 of the base body 1 and the panel 7, or internally to the panel 7, between the panel 7 and said fastening element 9. These mounting modes as well as complementary features that make it possible in each case to transmit the light from the LEDs 17 to the bezel 2 of the base body 1 of the corresponding pushbutton-type switch assembly will be described later in detail.

In the two lighted module embodiments shown in FIGS. 3 and 4, the LEDs 17 are regularly spaced around the corresponding aperture 22 in a first face of the printed circuit board 16, while said connection pins 18 extend from a second face of the printed circuit board 16 opposite to said first face. However, for the purpose of the present invention a single LED 17 would be sufficient, and if there were more than one, these could be arranged in any other form different to that shown provided that they could emit light towards the bezel 2 of the base body 1. Similarly, the connection pins 18 could be installed in a different fashion to that shown, or could be replaced by other connection means provided that they carry out an equivalent function.

With particular reference now to FIG. 3, in this first embodiment of the lighted module of the present invention, the receptacle 15 comprises a box 24 adapted to house the printed circuit board 16 and a cover 25 adapted to close said box 24. Said aperture 20 is formed in box 24 whereas in said cover 25 a corresponding aperture 21 aligned with the aperture 20 of the box 24 is formed. In this first embodiment, the box 24 is installed in an upper position and the cover 25 in a lower position. The aperture 20 of the box 24 has a square shape with rounded corners in order to fit to the particular form of the stem 5 of the first example of pushbutton-type switch assembly to which it is applied. Advantageously, the box 24 is made of a translucent or transparent material, for example, a polycarbonate plastic, and has a bottom wall that presents an inner surface adjacent to the first face of the printed circuit board 16. In order to accommodate the LEDs 17 that project slightly from the first face of the printed circuit 16, depressions 8 are formed on the inner surface of the bottom wall to that end, taking into account that the transmission of the light is guaranteed by the translucent or transparent material of the box 24. In an embodiment, the bottom wall of said depressions has one or more configurations adapted to modify the conditions of reflection or refraction of the light passing therethrough. Alternatively, the mentioned depressions 8 may be replaced by holes made for the same purpose. Similarly, other depressions and/or holes 26 are formed on said inner surface of the bottom wall of the box 24 adapted to accommodate other projecting elements from the first face of the printed circuit board 16, such as soldered points at the ends of the connection pins 18 and/or some circuit electronic components.

When it is fitted closing the box 24, the cover 25 has an inner surface adjacent to said second face of the printed circuit board 16 from which only the connection pins 18 project, for which reason an orifice 19 is formed to allow the connection pins 18 pass through. The box 24 has lateral walls 27 adapted to conform at least part of the printed circuit board 16 contour and the mentioned inner surface of the cover 25 has formed a perimetrical step 28 adapted to fit interiorly to said lateral walls 27 of the box 24. In this manner, the printed circuit board 16 is encapsulated and protected inside the receptacle 15 formed by the box 24 and the cover 25, jointly constituting the first embodiment of the lighted module of the present invention. This first embodiment of the lighted module may be applied to a pushbutton-type switch assembly according to the first example described in relation to FIG. 1, simply by inserting the lighted module between the panel 7 and the nut 9 of the pushbutton-type switch assembly. The only modification necessary is the provision of holes 23 in the panel 7 in positions around the aperture 6 coincident with the positions of the LEDs 17 to allow the light from the LEDs 17 to be emitted towards the bezel 2 of the base body 1 in the case that the same is completely made of a translucent or transparent material, or towards one or more of the mentioned translucent or transparent portions of the bezel 2 of the base body 1 in the case in which the same is formed in this way. The light from the LEDs 17 is preferably emitted through a surrounding exterior wall 51 of the bezel 2 of the base body 1 because it is an area of the same that is not occupied by the pushbutton 3, which is generally equipped with its own illumination means, such as the central light-emitting device 49 and because the illumination in this peripheral zone allows the creation of surprising light effects in combination with the central illumination, as described below.

In a non-illustrated variant of this embodiment, the box 24 is installed in a lower position and the cover 25 in an upper position. In this case, the box 24 includes hole 26 for the connection pins 18 and the aperture 21 of the cover is configured to encompass the LEDs 17 within its perimeter.

Figure 8:
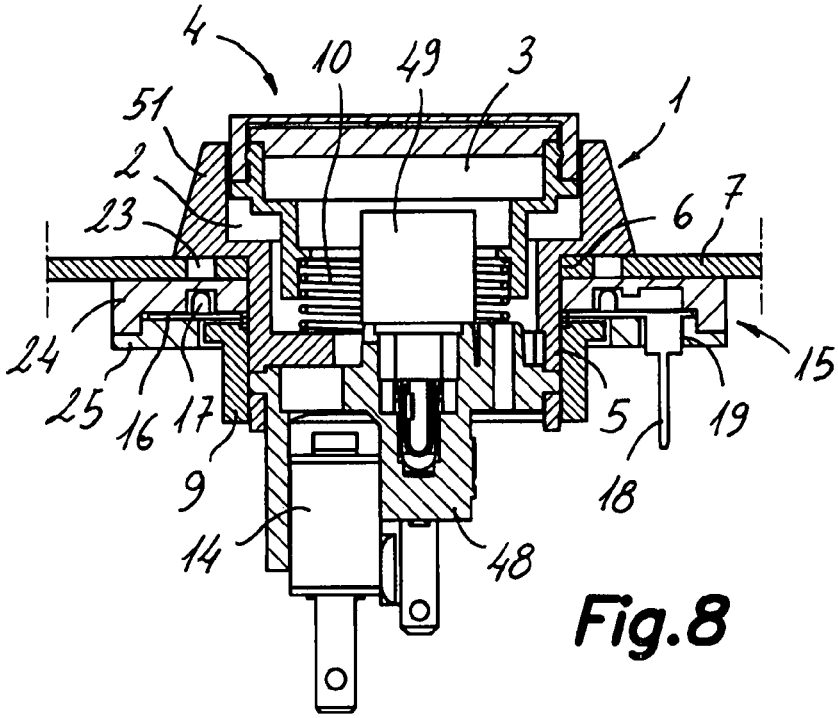
FIG. 8 is a cross-section of the first exemplary embodiment of the lighted module of FIG. 3 assembled and coupled in an operative situation to the first example of previous art pushbutton-type switch assembly as per said first installation example.

FIG. 8 shows the first embodiment of the lighted module assembled and coupled in an operative situation to the first example of previous art pushbutton-type switch assembly as per a first installation example in which the module is installed internally between the nut 9 and the panel 7. In this mounting, the stem 5 of the base body 1 of the pushbutton-type switch assembly passes through the aperture 6 of the panel, a rear surface of the bezel 2 of the base body 1 rests on the exposed face of the panel 7, and an outer surface of the bottom wall of the box 24 of the module is adjacent to the hidden face of the panel 7. In this embodiment shown in FIG. 8, the aperture 21 of the cover 25 is dimensioned to allow the nut 9 to pass through so that the nut 9 coupled to the stem 5 of the base body 1 tightens directly on the printed circuit board 16 to jointly support the lighted module and the pushbutton-type switch assembly to the panel 7, while the cover 25 is attached to the box 24. This is to provide a length of the outer threaded portion of stem 5 sufficient to guarantee correct coupling of the nut 9 when the length of the stem 5 of the existing pushbutton-type switch assembly is relatively short. In the case that the stem 5 of the pushbutton-type switch assembly is of sufficient length, the aperture 21 of the cover 25 can be dimensioned so that the nut 9 tightens on the same.

The LEDs 17 on the printed circuit board 16 are facing the holes 23 in the panel 7 and, in turn, these are facing the surrounding exterior wall 51 of the bezel 2 of the base body 1. As is usual, the central light-emitting device 49 is directly facing the pushbutton 3 of the actuator assembly 4. Connection wires (not shown) are installed to connect the switch 14 of the pushbutton-type switch assembly to a conventional electric or electronic circuit and other connection wires (not shown) are installed to connect the connection pins 18 of the lighted module to another electric circuit that is associated with an electronic control circuit to control operation of the LEDs 17 on the printed circuit board 16. Eventually, the two circuits could be combined into the same electric circuit, including the electronic control means.

According to a second installation example (not shown), the lighted module comprising box 24, printed circuit board 16 and cover 25 can be installed externally between the panel 7 and the bezel 2 of the base body 1, in which case the panel 7 will include an orifice (not shown) for the connection pins 18 instead of the holes 23.

Figure 5:
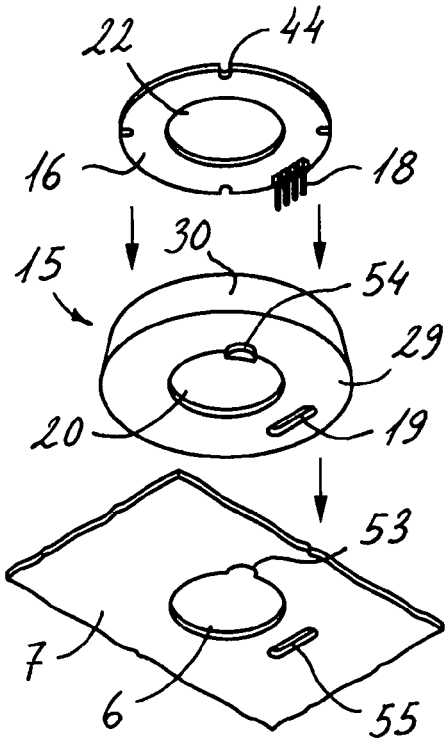
FIG. 5 is a lower perspective view showing a box and a printed circuit board of the second embodiment of the lighted module shown in FIG. 4 facing a panel suitable for a second installation example.
Figure 6:
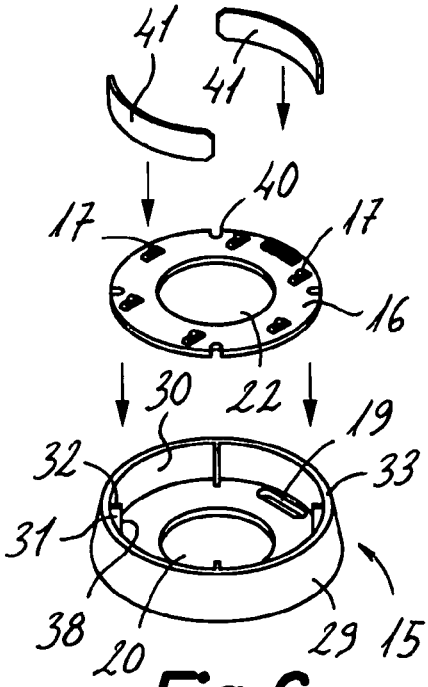
FIG. 6 is an upper perspective view showing a mounting arrangement of the box and printed circuit board of FIG. 4 by means of securing strips.

Referring now particularly to FIG. 4, the second embodiment of the lighted module of the present invention is shown, in which the receptacle 15 comprises a box 29 having a bottom wall to which the printed circuit board 16 is attached, and lateral walls 30 adapted to conform at least part of the printed circuit board 16 contour. The aperture 20 of previously mentioned receptacle 15 is formed in said bottom wall of said box 29, intended for insertion of stem 5 of the base body 1. In this embodiment, the box 29 has a circular shape and the lateral walls 30 take the form of a single lateral wall 30 of annular configuration, although it must be taken into account that for the purpose of the present invention other configurations are possible for the box 29 having multiple lateral walls 30. The second face of the printed circuit board 16 is adjacent to the bottom wall of the box 29 so that the mentioned orifice 19 is formed in the bottom wall of the box 29 to allow the connection pins 18 to pass through (FIGS. 5 and 6).

The box 29 does not have a cover and the lateral wall 30 defines an upper aperture facing the bottom wall on which the printed circuit board 16 is resting, said upper aperture being configured to encompass the LEDs 17 within its perimeter. The lateral wall 30 comprises a free axial edge 33 parallel to the bottom wall. This free axial edge 33 of the lateral wall 30 is adapted to rest against the hidden face of the panel 7 when the box 29 is internally installed to the panel 7, between the panel 7 and the nut 9, as per a first installation example described in greater detail below in relation to FIG. 9. Inner walls 31 extend radially from the lateral wall 30 towards the inside of the box 29. Each of said inner walls 31 has a free axial surface 32 either level with or more interior than said free axial edge 33 of the lateral wall 30 (FIG. 6). These free axial surfaces 32 of the inner walls 31 are adapted to support the bezel 2 of the base body 1 when the box 29 is installed externally to the panel 7, between the bezel 2 of the base body 1 and the panel 7 as per a second mounting assembly described in greater detail below in relation to FIG. 10.

Figure 9:
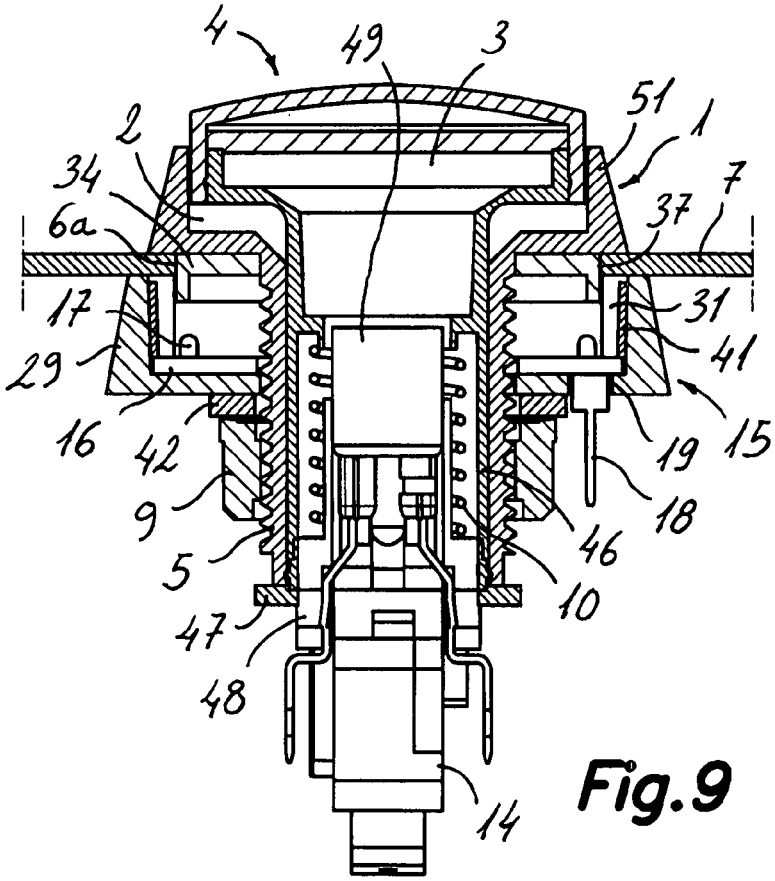
FIG. 9 is a cross-section of the second embodiment of the lighted module of FIG. 4 assembled and coupled in an operative situation to the second example of previous art pushbutton-type switch assembly of FIG. 2 as per said first installation example.
Figure 10:
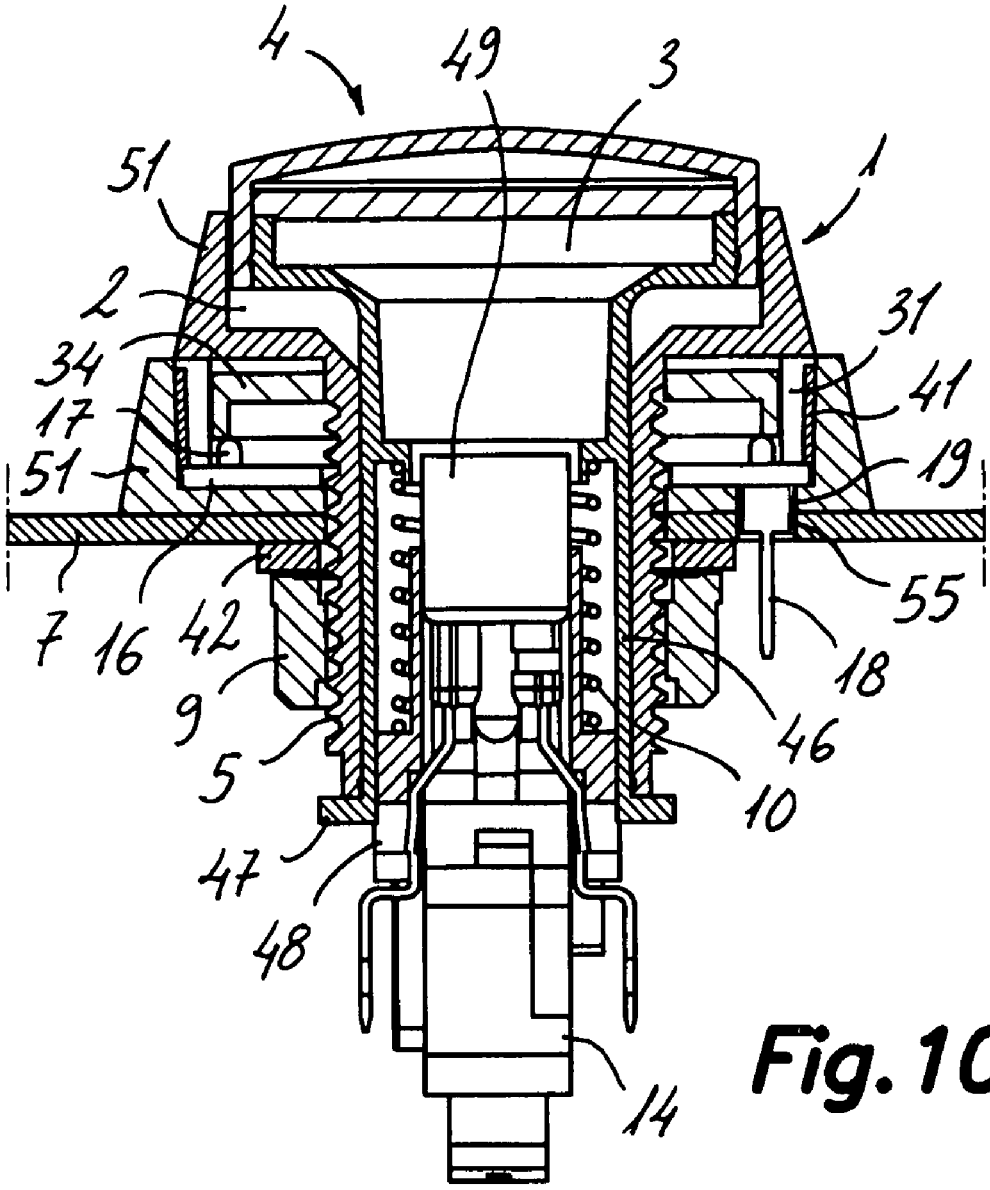
FIG. 10 is a cross-section of the second embodiment of the lighted module of FIG. 4 assembled and coupled in an operative situation to the second example of previous art pushbutton-type switch assembly of FIG. 2 as per said second installation example.
Figure 11A:
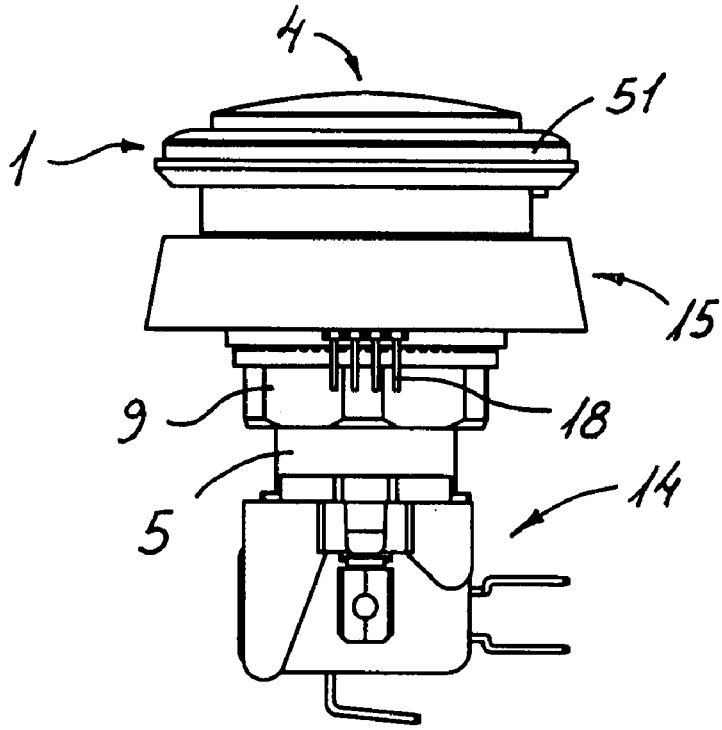
FIGS. 11A and 11B are side and top views, respectively, of another example of pushbutton-type switch assembly coupled to the lighted module according to the first embodiment of the present invention.
Figure 11B:
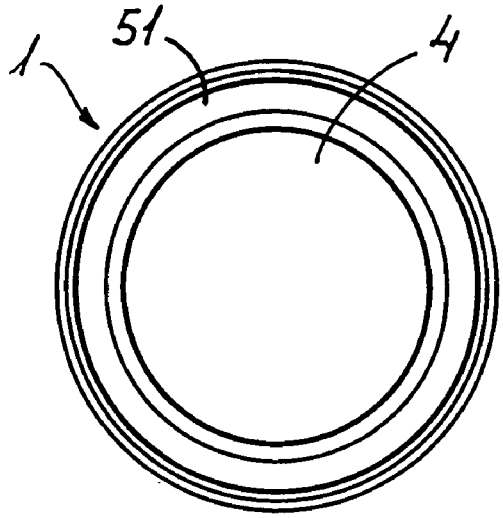

For the mentioned first installation example shown in FIG. 9, the panel 7 has an aperture **6*a* (FIG. 4) that is larger than an aperture 6 adapted for the second installation example shown in FIG. 10. Accordingly, the lighted module includes an adapter 34 made of a translucent or transparent material that has a contact surface 35 adapted to be backed onto a rear surface of the bezel 2 of the base body 1 and a perimetrical edge 37 adapted to adjust on an inner edge of the mentioned aperture 6*a* of the panel 7. Preferably, the adapter 34 includes a perimetrical wall, an outer surface of which is part of the mentioned perimetrical edge 37. In turn, the adapter 34 has an aperture 36 adapted to fit to an outer contour of the stem 5 of the base body 1 of the second example of previous art pushbutton-type switch assembly. The aperture 6*a* of the panel 7 and the perimetrical edge 37 of the adapter 34 have respective dimensions and configurations adapted to encompass within their perimeter the number of LEDs 17 on the printed circuit boards 16 installed inside the box 29. Thus, the light from the LEDs 17 is emitted towards the surrounding exterior wall 51 of the bezel 2 through the aperture 6*a* and through the adapter 34. However, the dimension of the perimetrical edge 37 of the adapter 34 is less than the dimension of the outer contour of the bezel 2 of the base body 1 of the pushbutton-type switch assembly so that part of the rear surface of the bezel 2 that projects out from the perimetrical edge 37 of the adapter 34 rests on the exposed face of the panel 7**.

The perimetrical edge 37 of the adapter 34 is also dimensioned to fit within free radial surfaces 38 of the inner walls 31 of the box 29, and the height of the perimetrical edge 37 of the adapter 34 is less than the distance from the first face of the printed circuit board 16 to the free axial surfaces 32 of the inner walls 31 so that the adapter can be held within the box 29 when employing the second installation example shown in FIG. 10.

Conventionally, there is a projection (not shown) on the rear surface of the bezel 2 of the base body 1, next to the stem 5, adapted to fit to a notch 53 (FIG. 2) provided on an edge of the aperture 6 of the panel 7 to prevent the rotation of the base body 1 with respect to the panel 7 when the pushbutton-type switch assembly is installed individually. In the lighted module, there is a notch 39 on the edge of the aperture 36 of the adapter 34 to receive said projection of the base body 1 when the first installation example shown in FIG. 9 is employed. In a similar way, there is a projection 54 (FIG. 5) on the rear surface of the bottom wall of the box 29, next to the aperture 20, adapted to fit into said notch 53 provided on an edge of the aperture 6 of the panel 7 to prevent the rotation of the base body 1 with respect to the panel 7 when the second installation example shown in FIG. 10 is employed. In this case, the panel 7 has an orifice 55 aligned with the orifice 19 of the box 29 to allow the connection pins 18 to pass through.

The lighted module of this second embodiment also includes a support washer 42 (FIG. 4), which has a first face adapted to back up to a rear surface of the bottom wall of the box 29, a second face adapted to receive a pressure surface 43 of the nut 9 and an aperture 44 adapted to adjust to an outer contour of the stem 5 of the base bottom 1. On an edge of this aperture 44, there is a notch 45 to fit to said projection of the rear surface of the bottom wall of the box 29, the thickness of said support washer 42 being equal to or greater than the axial length of said projection. In this way, the support washer 42 ensures correct transmission of the pressure exerted by the nut 9 against the rear surface of the bottom wall of the box 29 when the first installation example shown in FIG. 9 is employed. The support washer 42 can also be located between the hidden face of the panel 7 and the nut 9 when the second installation example shown in FIG. 10 is employed, which would also prevent the support washer 42 from being lost.

Also referring to FIGS. 5 and 6, the printed circuit board 16 has slots 40 in its contour to accommodate the mentioned inner walls 31 of the box 29. In order to hold the printed circuit board 16 with its second face adjacent to the surface of the bottom wall of the box 29, the module includes some securing strips 41, each of which has a curved configuration and a length adapted so that the support sheet 41 is held between two of said inner walls 31 and interiorly backed onto the lateral walls 30 of the box 29, as shown in FIG. 4. In this position, lower edges of the securing strips 41 are disposed above a portion of the printed circuit board 16 adjacent to its outer contour, thus securing the printed circuit board 16 to the box 29. A pair of securing strips 41, in diametrally opposite positions is sufficient to provide correct securing.

Figure 7:
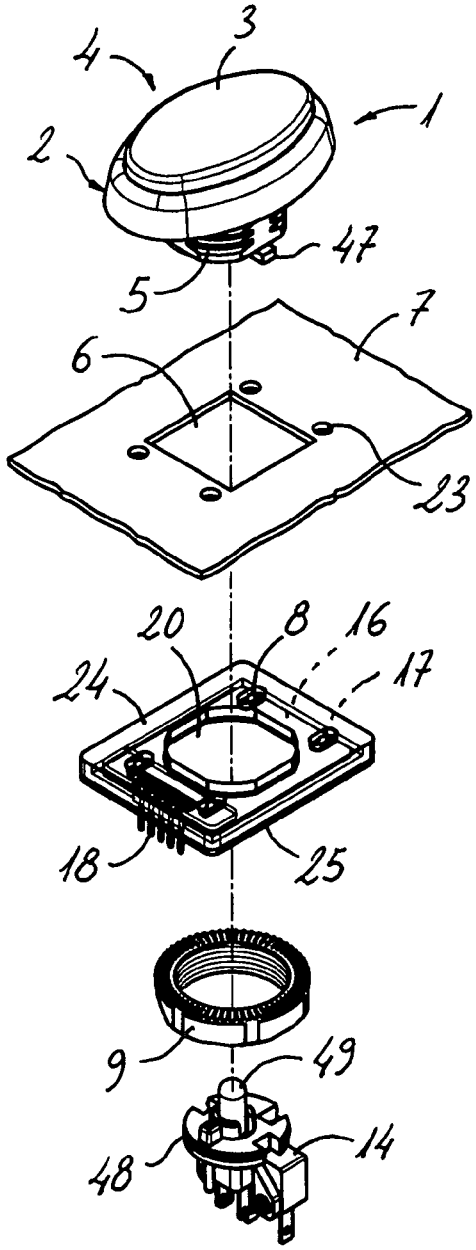
FIG. 7 is an exploded perspective view of a lighted module according to a variant of the first embodiment of the present invention to be applied to a variant of the previous art pushbutton-type switch assembly shown in FIG. 1.

FIG. 7 shows a lighted module according to a variant of the first embodiment of the present invention, applied to a variant of the first example of previous art pushbutton-type switch assembly, which only differs from the previous art pushbutton-type switch assembly shown in FIG. 1 in that the bezel 2 of the base body 1 is elliptical in concordance with an elliptical configuration of the pushbutton 3 of the actuator assembly 4. Consequently, the layout of the LEDs 17 on the printed circuit board 16 is adapted so that they can emit light through the surrounding exterior wall 51 of the bezel 2 and the same occurs with the depressions 8 or holes in the inner surface of the bottom wall of the box 24 which, together with the cover 25, constitutes the receptacle 15. Accordingly, the holes 23 in the panel 7 are arranged in alignment with the depressions 8 or holes in the box 24.

In the lighted module according to any of the embodiments of the present invention, the circuit of the printed circuit board 16 is adapted to switch the LEDs 17 on and off in order to produce various luminous signals under the control of an electronic circuit associated with said electric circuit to which the connection pins 18 of the printed circuit board 16 are connected. One of these luminous signals that is especially preferred is a rotating luminous signal produced by consecutively switching the LEDs 17 on and off. By virtue of a sequence and speed in the LEDs switching on and off, the effect produced is that of one or more lights rotating inside the surrounding exterior wall 51 of the bezel 2 of the base body 1 of the pushbutton-type switch assembly around the pushbutton 3. Moreover, the electronic control circuit can control the circuit of the printed circuit board 16 to vary the rotational speed and/or invert the direction of rotation of the luminous effect. The luminous signals produced by the lighted module of the present invention may be combined with other luminous signals produced by the mentioned one or more central light-emitting devices 49 arranged inside the stem 5 of the pushbutton-type switch assembly to emit light through the translucent or transparent cover 50 of the pushbutton 3 of the actuator assembly 4.

As previously described, the lighted module of the present invention may be manufactured separately to be afterwards applied to a previously existing pushbutton-type switch assembly which, in essence, has the characteristics described above in relation to FIGS. 1 and 2. However, the present invention also covers the possibility of manufacturing and/or marketing a pushbutton-type switch assembly incorporating a lighted module, with the pushbutton-type switch assembly being of the type described above in relation to FIGS. 1 and 2 and the lighted module being in accordance with any of the embodiments of the present invention.

Those skilled in the art would be able to introduce variations and modifications to the described and illustrated embodiments without departing from the scope of the present invention, as defined in the attached claims.

The invention claimed is:

1. A lighted module applicable to a pushbutton-type switch assembly, where said pushbutton-type switch assembly is of the type comprising a base body defining at one end a bezel adapted to receive a pushbutton of an actuator assembly and a stem adapted to pass through an aperture of a panel, said stem having an outer configuration adapted for joining said base body to said panel, said actuator assembly being mounted so as to be moved through said stem from an extended position to a retracted position against the thrust of an elastic element to operate an actuating element of a switch attached to said stem, said lighted module comprising:

a receptacle inside of which a printed circuit board is installed, said printed circuit board having a circuit including at least one LED and connection means, said receptacle including at least one translucent or transparent portion, aperture or hole through which light is emitted from said LED towards a translucent or transparent portion of the base body, and at least one orifice through which said connection means is connected to an electric circuit, the receptacle and said printed circuit board comprising respective mutually aligned apertures and for insertion of the stem of the base body, so that the receptacle with the printed circuit board is jointly installed with the pushbutton-type switch assembly either internally or externally to the panel, wherein said circuit of the printed circuit board includes a number of LEDs distributed around said aperture on a first face of the printed circuit board, while said connection means comprises connection pins extending from a second face of the printed circuit board opposite said first face, and the receptacle comprises a box adapted to house the printed circuit board and a cover adapted to close said box, said apertures of the receptacle being formed in said box and in said cover, respectively.

2. The module according to claim 1, wherein the box is made of a translucent or transparent material and has a bottom wall adjacent to the first face of the printed circuit board, whereas the cover is adjacent to said second face of the printed circuit board, said orifice being formed in the cover to allow said connection pins pass through.

3. The module according to claim 2, wherein depressions and/or holes adapted to accommodate the LEDs and/or other elements projecting from the first face of the printed circuit board are formed in an inner surface of said bottom wall of the box.

4. The module according to claim 1, wherein the box has a bottom wall adjacent to the second face of the printed circuit board whereas the cover is adjacent to said first face of the printed circuit board, said orifice being formed in said bottom wall of the box to allow said connection pins pass through, said aperture of the cover being configured to encompass the LEDs within its perimeter.

5. The module according to claim 4, wherein the box has some walls adapted to conform at least in part to the contour of the printed circuit board and the cover forms a perimetrical step adapted to interiorly fit into said lateral walls of the box.

6. The module according to claim 1, wherein the LEDs are arranged on the printed circuit board so as to emit light through corresponding holes existing in the panel adjacent to the aperture thereof when the lighted module is installed internally between a securing element fastened to the stem of the base body and the panel.

7. The module according to claim 1, wherein the connection pins are installed on the printed circuit board so as to pass through an orifice existing in the panel adjacent to the aperture thereof when the lighted module is installed externally between the panel and the bezel of the base body.

8. The module according to claim 1, wherein the circuit of the printed circuit board is adapted to be controlled by an electronic control circuit associated with said electric circuit to which the connection pins on the printed circuit board are connected to consecutively switch the LEDs on and off so as to produce a rotating luminous signal.

9. The module according to claim 1, wherein the LEDs are installed on the printed circuit board so as to emit said rotating luminous signal through a peripheral zone of the bezel of the base body, at least said peripheral zone being made of a translucent or transparent material.

10. A pushbutton-type switch assembly with a lighted module, said pushbutton-type switch assembly being of the type comprising a base body defining at one end a bezel adapted to receive a pushbutton of an actuator assembly and a stem adapted to pass through an aperture in a panel, said stem having an outer configuration adapted to be coupled to a securing element for joining said base body to the cited panel, said actuator assembly being mounted so as to be moved through said stem from an extended position to a retracted position against the thrust of an elastic element to operate an actuating element of a switch attached to said stem, said pushbutton-type switch assembly being associated with a lighted module according to claim 1 and in that the base body has at least one translucent or transparent portion through which light from said lighted module is emitted.

11. A lighted module applicable to a pushbutton-type switch assembly, where said pushbutton-type switch assembly is of the type comprising a base body defining at one end a bezel adapted to receive a pushbutton of an actuator assembly and a stem adapted to pass through an aperture of a panel, said stem having an outer configuration adapted for joining said base body to said panel, said actuator assembly being mounted so as to be moved through said stem from an extended position to a retracted position against the thrust of an elastic element to operate an actuating element of a switch attached to said stem, said lighted module comprising:

a receptacle inside of which a printed circuit board is installed, said printed circuit board having a circuit including at least one LED and connection means, said receptacle including at least one translucent or transparent portion, aperture or hole through which light is emitted from said LED towards a translucent or transparent portion of the base body, and at least one orifice through which said connection means is connected to an electric circuit, the receptacle and said printed circuit board comprising respective mutually aligned apertures and for insertion of the stem of the base body, so that the receptacle with the printed circuit board is jointly installed with the pushbutton-type switch assembly either internally or externally to the panel, wherein said circuit of the printed circuit board includes a number of LEDs distributed around said aperture on a first face of the printed circuit board, while said connection means comprises connection pins extending from a second face of the printed circuit board opposite said first face, and the receptacle comprises a box with a bottom wall to which the printed circuit board is attached and lateral walls adapted to conform at least part to the contour of the printed circuit board, said aperture of the receptacle being formed in said bottom wall.

12. The module according to claim 11, wherein the bottom wall of the box is adjacent to the second face of the printed circuit board, said orifice being formed in the bottom wall to allow said connection pins to pass through and said lateral walls defining an aperture configured to encompass the LED switch in its perimeter.

13. The module according to claim 12, wherein said lateral walls of the box have a free axial edge adapted to rest on the panel around said aperture when the lighted module is installed internally between a securing element attached to the stem of the base body and the panel, and in that the lighted module includes an adapter of a translucent or transparent material having an aperture adapted to fit to an outer contour of the stem of the base body and a perimetrical edge adapted to fit to an inner edge of the aperture of the panel, said aperture and said perimetrical edge being configured to encompass said number of LEDs within its perimeter.

14. The module according to claim 13, wherein the box comprises inner walls that radially extend inwards from said lateral walls, said inner walls having free axial surfaces adapted to support the bezel of the base body when the lighted module is installed externally between the panel and the bezel of the base body, in which case the connection pins are arranged so that they pass through an orifice formed in the panel and aligned with the orifice of the box.

15. The module according to claim 14, wherein the perimetrical edge of the adapter includes an outer perimetrical surface adapted to fit inside free radial surfaces of the inner walls of the box, said perimetrical edge having a height that is less than the distance between the first face of the printed circuit board and the free axial surfaces of the inner walls.

16. The module according to claim 14, wherein the adapter has a notch formed in an edge of said aperture to fit into a projection formed on the rear surface of the bezel of the base body.

17. The module according to claim 14, wherein the printed circuit board has slots around its contour to accommodate the inner walls of the box, securing strips being adapted to be held between two of said inner walls and interiorly backed onto the lateral walls of the box above a portion of the printed circuit board adjacent to its contour to hold the printed circuit board to the box.

18. The module according to claim 13, further comprising a support washer having a first face adapted to be backed onto a rear surface of the bottom wall of the box, a second face adapted to receive a pressure surface of the securing elements, and an aperture adapted to fit to an outer contour of the stem of the base body, a notch being formed in an edge of said aperture to fit to a projection formed on the rear surface of the bottom wall of the box, the thickness of said support washer being equal to or greater than the axial length of said projection.

* * * * *